United States Patent [19]

Krueger et al.

[11] Patent Number: 4,948,120

[45] Date of Patent: Aug. 14, 1990

[54] PORTABLE, SELF-SUPPORTING, BABY CARRIER APPARATUS

[76] Inventors: Deborah Krueger, 6504 Oak Hollow La., Charlotte, N.C. 28212; Damon Snyder, 2081 Edgewater Ct., Lexington, Ky. 40502

[21] Appl. No.: 369,067

[22] Filed: Jun. 20, 1989

[51] Int. Cl.[5] ..... A63G 9/00

[52] U.S. Cl. ..... 272/85; 272/92; 297/274

[58] Field of Search ..... 272/85–92; 297/273–278

[56] References Cited

U.S. PATENT DOCUMENTS

| | | | |
|---|---|---|---|
| 16,942 | 3/1857 | Wellman . | |
| 418,938 | 1/1890 | Bogusch . | |
| 838,072 | 12/1906 | Benner . | |
| 993,747 | 5/1911 | Blachmann . | |
| 1,603,578 | 10/1926 | Biernat | 297/273 X |
| 1,847,992 | 3/1932 | Upper . | |
| 2,697,477 | 12/1954 | Welsh . | |
| 2,944,815 | 7/1960 | Moyer . | |
| 3,128,076 | 4/1964 | Di Pasqua . | |
| 3,256,016 | 6/1966 | Berlin . | |
| 3,519,239 | 7/1970 | Rohrer | 272/85 |
| 3,794,317 | 2/1974 | Barrett . | |
| 4,537,293 | 8/1985 | Deflbaugh . | |
| 4,844,452 | 7/1989 | Tomosky et al. | 272/85 |

FOREIGN PATENT DOCUMENTS

| | | | |
|---|---|---|---|
| 339715 | 8/1959 | Switzerland | 297/274 |

*Primary Examiner*—Richard E. Chilcot, Jr.
*Attorney, Agent, or Firm*—Bell, Seltzer, Park & Gibson

[57] ABSTRACT

This invention relates generally to a portable, self-supporting baby carrier apparatus. More specifically, the invention concerns an apparatus that is easily set up or collapsed and stored, and when it is set up, it becomes a free-standing, self-supporting baby jumper or the like with a solid support structure. The invention overcomes the drawbacks of the earlier swing sets and jumpers by providing a stable frame mounted on a base. Further, in the case of the baby jumper, the jumper set is suspended from a specific spring configuration that restricts the lateral movement of a child in the jumper seat.

16 Claims, 4 Drawing Sheets

PORTABLE, SELF-SUPPORTING, BABY CARRIER APPARATUS

BACKGROUND OF THE INVENTION

This invention relates generally to a portable, self-supporting baby carrier apparatus. More specifically, the invention concerns an apparatus that is easily set up or collapsed and stored, and when it is set up, it becomes a free-standing, self-supporting baby jumper or the like with a solid support structure.

Swing sets of various shapes and sizes have been in existence for many years. Generally, they have four legs that are buried in the ground or set in cement to fix them in a given location. These structures are heavy and unwieldy and, at the very least, very difficult to move. Smaller, potentially portable swings and accompanying frames exist, as described for example in U.S. Pat. Nos. 2,697,477 to Welsh, 3,128,076 to Di Pasqua, 3,256,016 to Berlin, and 3,794,317 to Barrett. However, these types of available, portable swings and the like are very unstable and tip over easily. Commercially available portable frames having springs and baby jumper seats are particularly unstable in general. The weight and momentum of an infant pressing against a floor to bounce up and down in a portable jumper merely having four legs may cause an apparatus to "walk" across the floor or to fall over.

Also available are jumping devices of the type having a seat suspended by springs from a stationary location, typically a door frame, such as the commercially available "Johnny Jump-Up" device. While this structure is stable, it is not portable and is limited to only a few possible locations for mounting. See generally U.S. Pat. No. 838,072 to Benner. These configurations also allow an infant too much lateral freedom of movement as the infant may easily harm itself by accidentally bumping into the door frame.

SUMMARY OF THE INVENTION

The present invention overcomes the drawbacks of these earlier swing sets and jumpers by providing a stable frame that is easily collapsible for storage and transport. The frame includes a base that enhances the stability of the entire structure. In the situation of both a swing or a jumper, the child or infant that is swinging or jumping in a seat suspended from the apparatus will use the base as a push-off point. The force exerted by the child in pressing against the base in either swinging or bouncing counteracts the momentum of the bouncing and swinging in the opposite direction.

Further, the invention includes support legs that are attached to the base and a headbar. Because the legs are attached to the base and are firmly attached to the headbar, the legs are more rigid than free-standing legs merely attached to a headbar. For greater flexibility of use, the length of the legs is adjustable to allow continued use of the apparatus as a child grows.

Additionally, in the case of the baby jumper, the specific configuration of the invention provides for greater stability by restricting the lateral movement of a child in a jumper seat. A child in a seat that is suspended solely from vertically mounted springs can move in virtually any lateral direction, thus contributing to the instability of an apparatus. The present invention suspends the jumper seat from an additional bar that is then attached to the headbar by substantially horizontally positioned springs. This minimizes the potential lateral wandering of a child in the jumper seat that could create an unstable situation.

It is an object of this invention to provide a stable, portable baby carrier apparatus. It is further an object of the present invention to solve the aforementioned problems of existing structures and apparatuses.

It is also an object of the present invention to provide a stable and portable baby carrier apparatus that is adjustable and adaptable to be used by infants and children of different ages and sizes.

Another object of the invention is to provide a baby jumper apparatus having a spring configuration that enhances stability of the entire structure.

Additionally, it is an object of the invention to provide a support frame having interchangeable baby carrier means to make the support structure usable in a number of different situations.

Other objects and advantages of the invention will become apparent upon reading the following detailed description and appended claims, and upon reference to the accompanying drawings.

BRIEF DESCRIPTION OF THE DRAWINGS

For a more complete understanding of this invention reference should now be had to the embodiments illustrated and described in greater detail hereinafter in connection with the accompanying drawings, in which.

DETAILED DESCRIPTION OF THE ILLUSTRATED EMBODIMENTS

Figure 1:
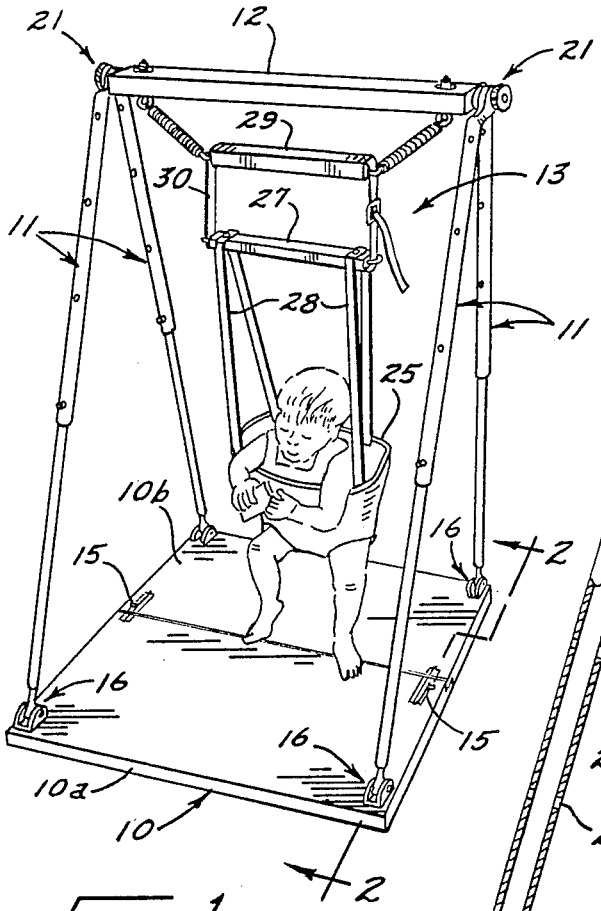
FIG. 1 is a perspective view of a portable baby jumper apparatus picturing one embodiment of the present invention.

Turning first to FIG. 1, there is shown a perspective view of a preferred embodiment of a portable baby jumper apparatus. A baby is shown in this drawing to illustrate the apparatus in actual use. The apparatus is comprised generally of a base 10, four support legs 11 carried by the base, a headbar 12, and a baby carrier means 13, in this case a baby jumper seat, suspended from the headbar.

Figure 4:
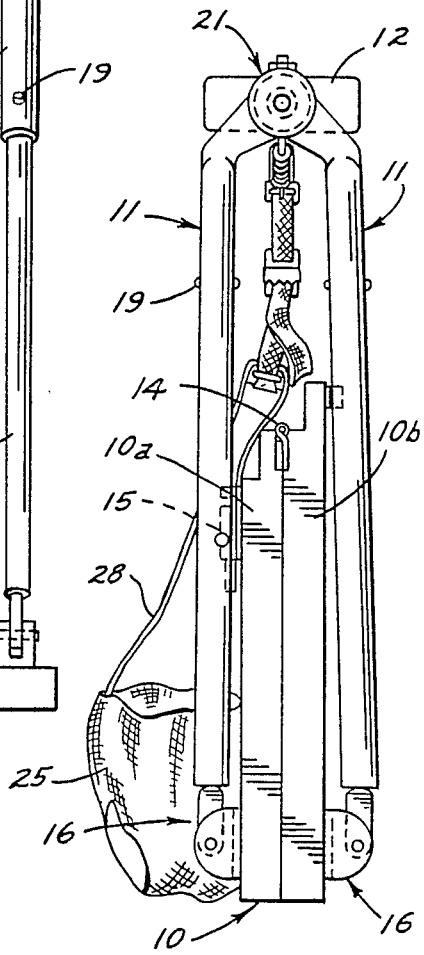
FIG. 4 is a side view of the portable baby jumper apparatus illustrated in FIG. 1 in its folded, collapsed, storage position.

More specifically, the base 10 of FIG. 1 is made up of two panels 10*a* and 10*b*. These panels are connected by one or more hinges 14 (see FIG. 2) and are locked together in their open position as shown in FIG. 1 by two sliding bolt locks 15. The lower end portion of the legs 11 are pivotally attached to the corners of the base 10 by pivoting connection means 16 fixedly bolted to the base 10 by conventional bolts and nuts 17 (see FIG. 2). A pin 18 then connects the lower portion of the leg 11 to the connection means 16 so that the leg may rotate around the pin so the base may be collapsed from its extended, open position to its folded, collapsed, storage position as shown in FIG. 4.

Figure 2:
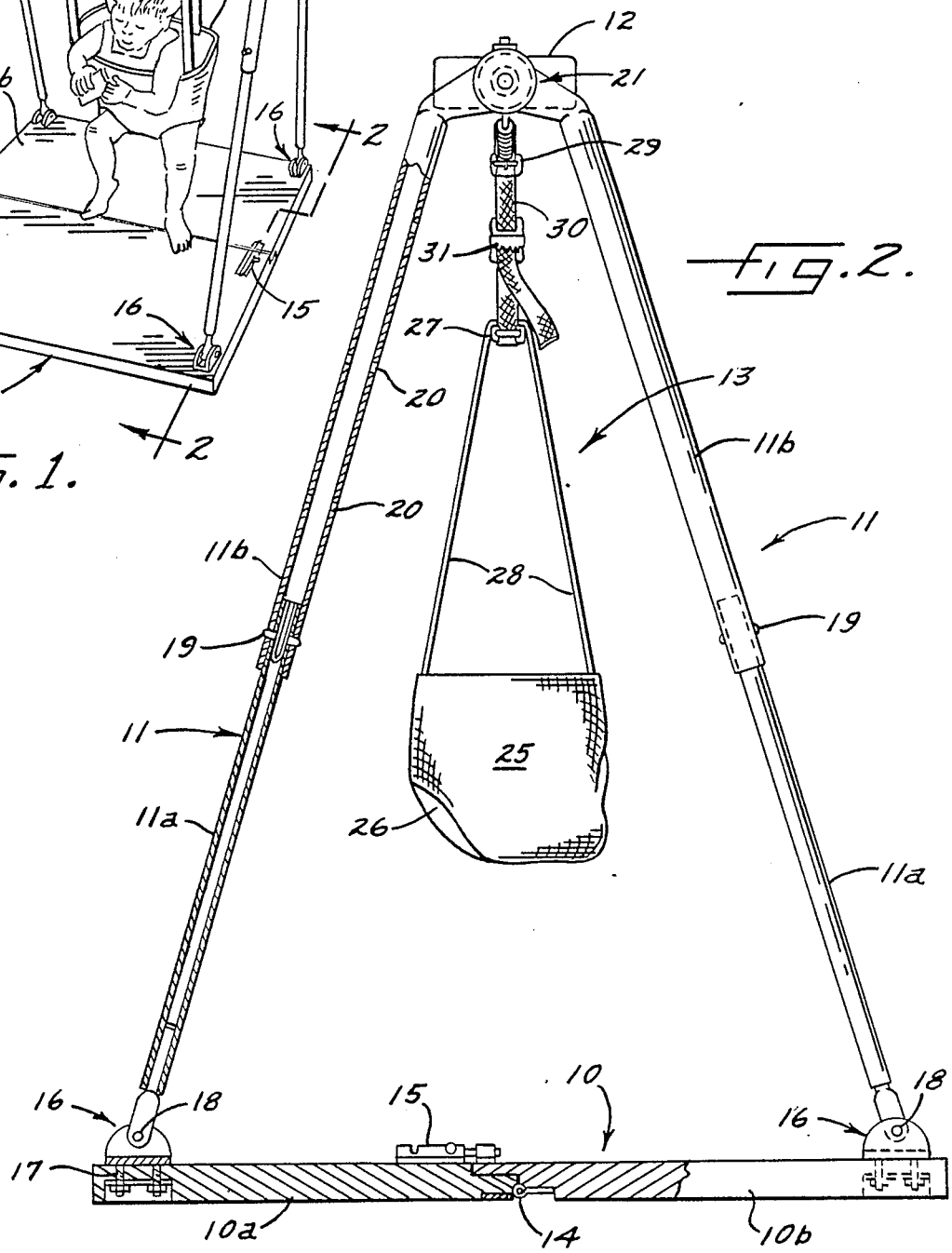
FIG. 2 is a side view of the baby jumper apparatus shown in FIG. 1 that is partially in crosssection along line 2—2 of FIG. 1.

As illustrated in FIG. 2, the legs 11 in the preferred embodiment are made of a tubular material. Further, the legs are each comprised of two sections 11*a* and 11*b*. The upper section of the leg 11*b* is of a larger diameter that is able to slidably accept the lower member 11*a*. At the top of the lower leg 11*a* is a locking button 19. The upper leg portion 11*b* has apertures 20 at set distances along its length. The locking buttons 19 extend through the apertures 20 and releasably lock the lower leg in relation to the upper leg. By squeezing the button 19, the button becomes disengaged from the aperture 20 and may be slidably moved to another aperture at another predetermined position along the upper leg. Thus, the height of the overall structure may be increased or decreased by adjusting the length of the legs. While locking button are used in the preferred embodiment, other methods, including pins or threaded tightening means may be used to adjustably set the height of the apparatus.

Returning now to FIG. 1, the support legs 11 are connected to the headbar 12. One pair of legs attached at either end of the headbar. The upper end portions of each pair of support legs comprises adjustable securement means 21. As more specifically shown in FIG. 3, there is a bolt 22 embedded in the headbar, a handle 23 and interlocking surfaces 24 at the upper end of each leg portion that cooperate with each other and that lock together upon threadably tightening the handle to the headbar by the bolt. The bolt 22 extends through a hole in the interlocking surfaces 24 of the legs and is threadably engaged by the handle 23. When the handle is tightened, the legs are rigidly locked with each other to the headbar. As the length of the legs 11 is adjusted by the locking buttons 19, the angle at which the legs interlock with the headbar changes. The rigidity is maintained by merely loosening the handle and pivoting the legs to their correct position and then locking them again by threadably tightening the handle to the headbar.

It is from the headbar 12 that various baby carrier means are suspended. In FIG. 1, there is a jumper seat; however, any type of chair or swing or cradle may also be suspended from this stable structure.

Figure 3:
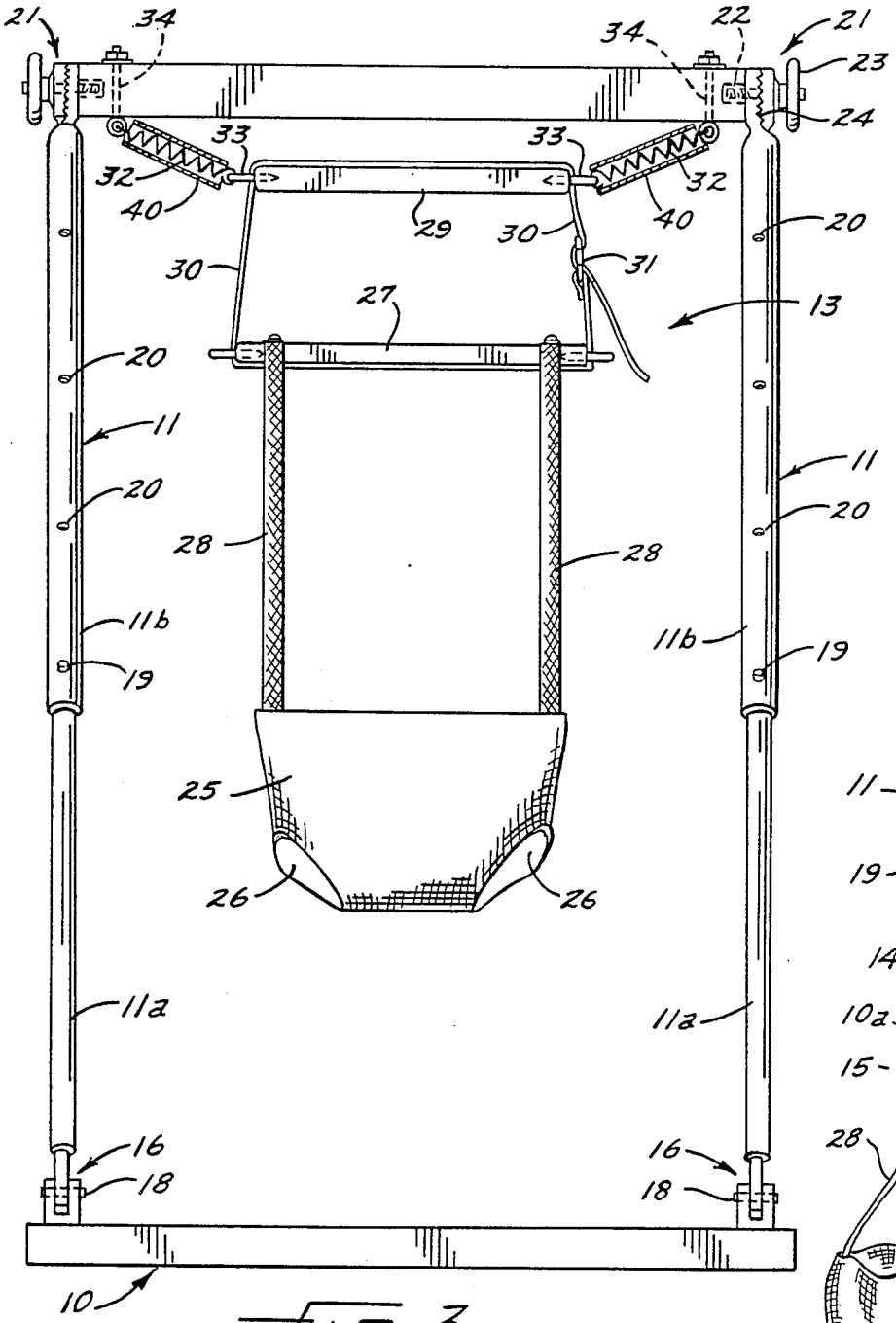
FIG. 3 is a front view of the baby jumper apparatus shown in FIG. 1.

FIG. 3 most clearly illustrates one embodiment of a baby carrier means in accordance with the present invention. A jumper seat 25 has two openings 26 through which an infant puts his legs (see FIG. 1). As indicated in the drawings, the seat is of sufficient height to hold an infant in an upright position above the base. The baby carrier means further includes a stabilizer bar 27 and straps 28 that connect the jumper seat to opposite ends of the stabilizer bar. There is also a suspension bar 29 and adjustable straps 30 that connect opposite ends of the stabilizer bar to the corresponding ends of the suspension bar. The adjustable strap includes a buckle 31 that allow the distance between the stabilizer bar and the suspension bar to be variable, thus lowering and/or raising the height of a child suspended above the base. And finally, springs 32 connect opposite ends of the suspension bar to the headbar so that an infant in the jumper seat may bounce up and down by pushing off against the base. The springs are connected to eye bolts 33 at opposite ends of the suspension bar and to eye bolts 34 at corresponding ends of the headbar. The springs are further encased in a flexible cover 40 that prevents a child from pinching its fingers in the springs.

Figure 7:
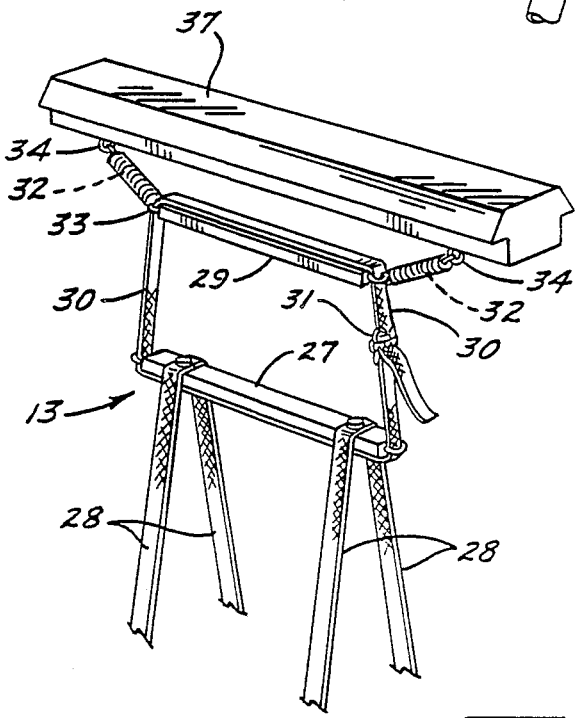
FIG. 7 is a perspective view of an elongate member, insertable in the apparatus shown in FIGS. 5 and 6, including one embodiment of the baby carrier means that may be attached to said elongate member.
Figure 8:
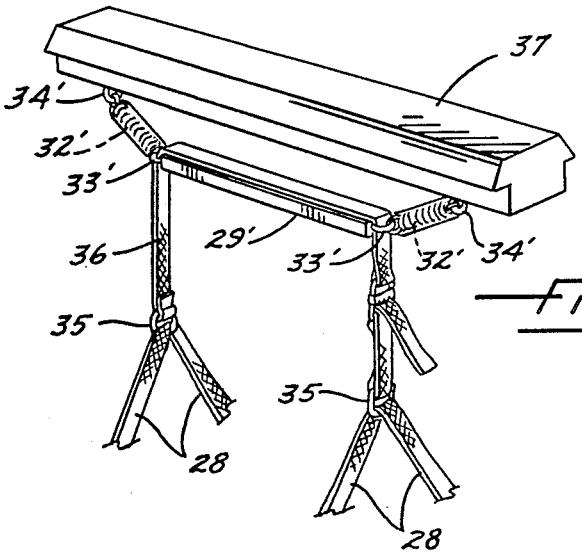
FIG. 8 is a perspective view like FIG. 7, and shows another embodiment of a baby carrier means.

As discussed earlier, other baby carrier means may be suspended from the headbar. The method for adjusting the height of the baby as shown in FIGS. 1 through 7 may be equally well replaced with suspension means as illustrated in FIG. 8. In FIG. 8, straps 28 are attached to D-rings 35. The D-rings 35 are then attached to an adjustable strap 36 that connects the D-rings to opposite ends of a suspension bar 29' similar to a suspension bar 29 in the alternate embodiment. The springs 32' and eye bolts 33' and 34' are similar to those described in connection with FIG. 3.

When the baby carrier means is a jumper seat as illustrated in FIGS. 1 through 8, it is preferred that the length of the suspension bar 29 is substantially less than the length of the headbar 12, and that the springs connect each end of the suspension bar to the corresponding end of the headbar as close as possible to the end of the headbar. As discussed earlier, this configuration restricts the lateral movement of the jumper seat and prevents an infant from potentially swinging out of control in any lateral direction.

Figure 5:
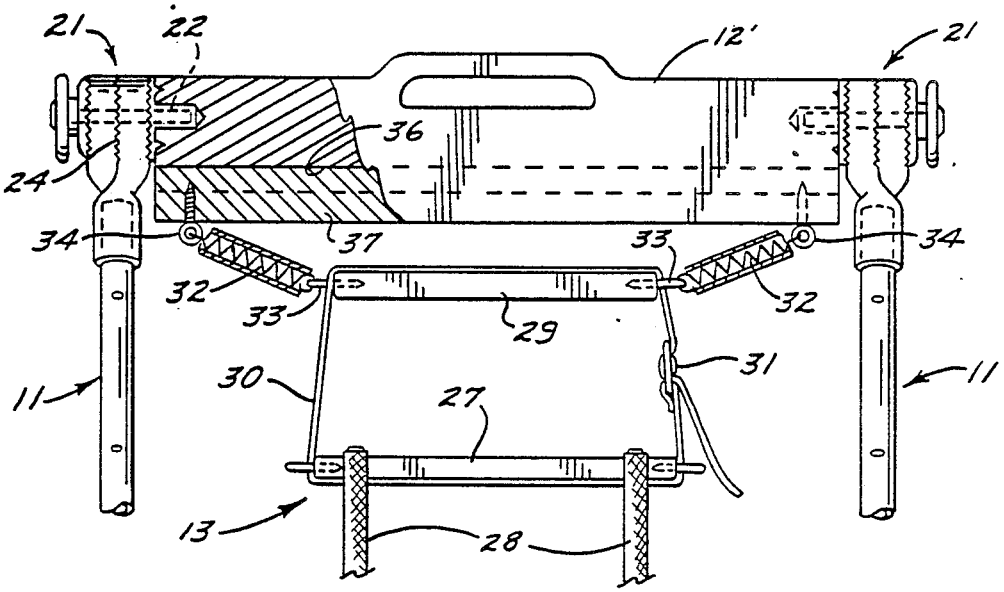
FIG. 5 is a front sectional view of the top portion of another embodiment of a baby jumper apparatus.
Figure 6:
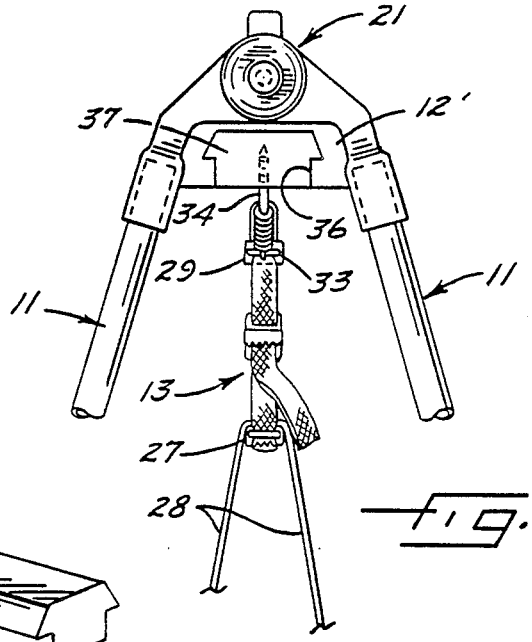
FIG. 6 is a side view of the top portion of the embodiment of the baby jumper apparatus shown in FIG. 5.
Figure 9:
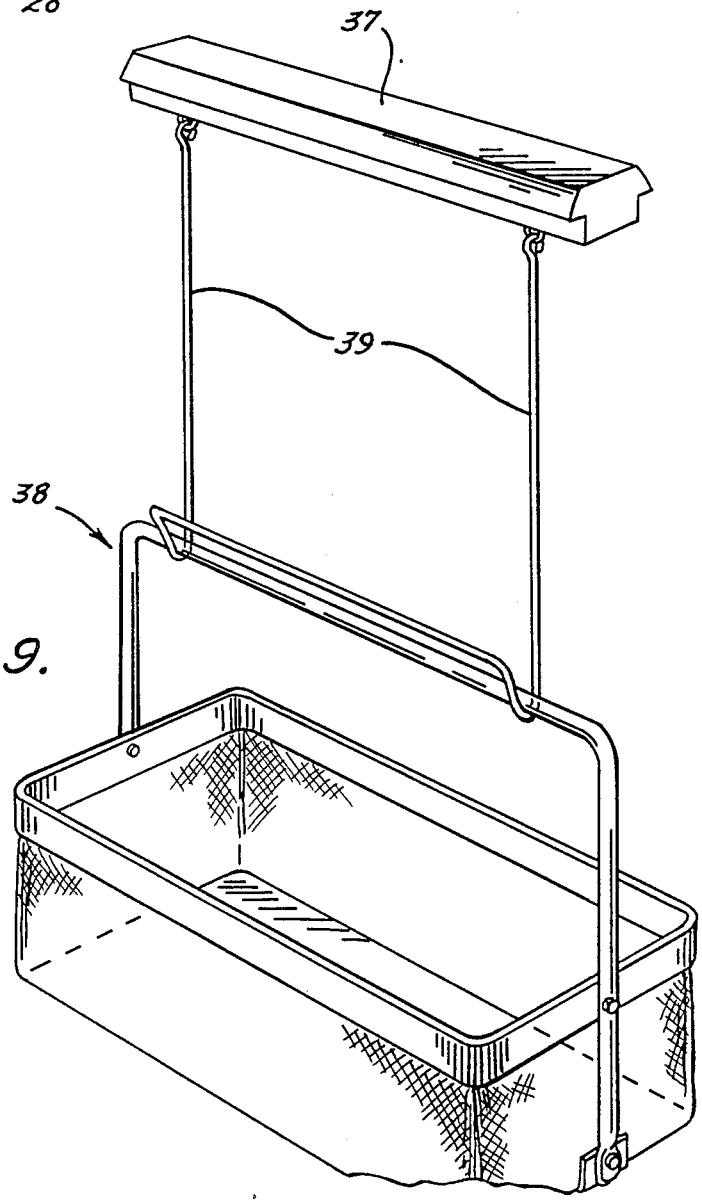
FIG. 9 is a perspective view like FIGS. 7 and 8 showing a further embodiment of a baby carrier means.

FIGS. 5 and 6 illustrate an alternate embodiment of the headbar configuration. The headbar 12' of FIGS. 5 and 6 further includes a longitudinal slot 36 and an elongate member 37 insertable into the slot. The elongate member is characterized by flanges along its length that are accepted into grooves in the slot. These flanges secure the elongate member in the headbar and support the weight of a suspended child in the jumper seat or the like. The baby carrier means 13 are attached to the elongate member 37 that is insertable in the slot 36. FIG. 7 illustrates an elongate member 37 to which is attached the baby carrier means illustrated in FIGS. 5 and 6. (Likewise, it is the same baby carrier means illustrated in FIGS. 1 through 4.) FIGS. 8 and 9 also illustrate an elongate member 37 insertable in the slot of the headbar 12'. FIG. 9 shows a cradle structure that is removably rested on a wire frame 39 suspended from the elongate member 37. As noted earlier, any type of swing or chair or cradle or jumper seat configuration can be attached to an elongate member and insertable in the slot of the headbar 12'.

As can seen in the drawings, particularly FIGS. 3 and 4, the apparatus may be collapsed by shortening the length of the legs, loosening the handle means 23 to allow the legs to pivotally slide against each other at the headbar, and disengaging the sliding bolt locking the base, thus allowing the base to pivot upwardly and into a compact, folded, storage position as shown in FIG. 4. The reverse steps may be taken to quickly set up the structure.

Obviously many modifications and other embodiments of the subject invention will readily come to one skilled in the art having the benefit of the teachings presented in the foregoing descriptions in accompaniment with the associated drawings. Therefore, it is to be understood that the invention is not to be limited thereto and that said modifications and embodiments are intended to be included within the scope of the appended claims.

That which is claimed is:

1. A portable baby carrier apparatus having enhanced stability and being easily collapsible for storage comprising a base comprising a plurality of panels hingedly interconnected for movement between an extended, open position and a folded, collapsed, storage position, a support frame carried by the base and comprising a headbar and a plurality of support legs, each leg having an upper end portion connected to the headbar and a lower end portion connected to the base so that when the base is collapsed from its extended, open position to its folded, collapsed, storage position, the frame will collapse into a compact storage position, and baby carrier means suspended from the headbar.

2. The apparatus described in claim 1 wherein each of said support leg includes length adjustment means.

3. The apparatus described in claim 1 wherein said base is rectangular and the support legs are connected to the corners of the base.

4. The apparatus described in claim 1 wherein said baby carrier means comprises a jumper seat having openings adapted to receive an infant's legs and to hold the infant in a generally upright position above said base and adjustable straps connecting the jumper seat to said headbar for raising and lowering the jumper seat above said base so that the infant's legs can reach and touch said base.

5. The apparatus described in claim 1 wherein said baby carrier means comprises a jumper seat having openings adapted to receive an infant's legs and to hold the infant in a generally upright position above said base, an elongate stabilizer bar, strap means connecting said jumper seat to opposite ends of said stabilizer bar, an elongate suspension bar, adjustable strap means connecting opposite ends of the stabilizer bar to the corresponding ends of said suspension bar for adjusting the height of the jumper seat above said base so that the infant's legs can reach and touch said base, and spring means connecting opposite ends of said suspension bar to said headbar so that an infant in the jumper seat may bounce up and down by pushing off against said base.

6. The apparatus described in claim 1 wherein said support frame includes a pair of said support legs at each end of said headbar, and adjustable securement means connecting upper end portions of each leg of the pair to the headbar so as to permit adjustably securing the legs in a fixed angular relationship to maintain the frame in its extended open position or in its collapsed storage position.

7. The apparatus described in claim 6 wherein said upper end portions of each pair of support legs include opposed, cooperating interlocking surfaces, and said adjustable securement means includes means for tightening said interlocking surfaces together to lock the legs in a fixed angular relationship.

8. The apparatus described in claim 1 wherein said baby carrier means comprises a jumper seat having openings adapted to receive an infant's legs and to hold the infant in an upright position above said base, an elongate suspension bar, adjustable straps connecting said jumper seat to said suspension bar, and spring means at each end of said suspension bar connected to the headbar.

9. The apparatus described in claim 8 wherein the length of said suspension bar is substantially less than the length of said headbar, and said spring means connect each end of said suspension bar to the corresponding end and substantially at the end of said headbar.

10. The apparatus described in claim 1 wherein said headbar further comprises a longitudinal slot and an elongate member insertable in said slot, said baby carrier means being suspended from said elongate member to thereby facilitate the use of different types of baby carrier means by interchangeably inserting different elongate members into said slot.

11. A portable baby jumper apparatus having enhanced stability and being easily collapsible for storage comprising a base comprising rectangular panels hingedly interconnected for movement between an extended, open position and a folded, collapsed storage position, a support frame carried by the base and comprising a headbar and four support legs, each having length adjustment means, an upper end portion of each leg being connected to the headbar and a lower end portion of each leg being connected to a corner of the base so that when the base is collapsed from its extended, open position to its folded, collapsed, storage position the frame will collapse into a compact storage position, and baby carrier means suspended from the headbar, the baby carrier means comprising a jumper seat having openings adapted to receive an infant's legs and to hold the infant in a generally upright position above said base, an elongate stabilizer bar, strap means connecting said jumper seat to opposite ends of said stabilizer bar, an elongate suspension bar, adjustable strap means connecting opposite ends of the stabilizer bar to the corresponding ends of said suspension bar for adjusting the height of the jumper seat above said base so the infant's legs reach to and touch said base, and spring means connecting opposite ends said suspension bar to said headbar so that an infant in the jumper seat may bounce up and down by pushing off against said base.

12. The apparatus as described in claim !1 wherein said support frame includes a pair of said support legs at each end of said headbar, and adjustable securement means connecting upper end portions of each leg of the pair to the headbar so as to permit adjustably securing the legs in a fixed angular relationship to maintain the frame in its extended open position or in its collapsed storage position.

13. A portable baby carrier apparatus having enhanced stability and being easily collapsible for storage and characterized by the ability to interchangeably support a number of different baby carrier means comprising a base comprising a plurality of panels hingedly interconnected for movement between an extended, open position and a folded, collapsed, storage position, a support frame carried by the base and comprising a headbar and a plurality of support legs, each leg having an upper end portion connected to the headbar and a lower end portion connected to the base so that when the base is collapsed from its extended, open position to its folded, collapsed, storage position, the frame will collapse into a compact storage position, said headbar comprising a longitudinal slot for accepting an elongate member, a plurality of elongate members insertable in said slot, and baby carrier means attached to each said elongate member to thereby facilitate the use of different types of baby carrier means by interchangeably inserting different elongate members into said slot.

14. The apparatus described in claim 13 wherein one of said baby carrier means comprises a jumper seat having openings adapted to receive an infant's legs and to hold the infant in a generally upright position above said base and adjustable straps connecting the jumper seat to said headbar for raising and lowering the jumper seat above said base so that the infant's legs can reach and touch said base.

15. The apparatus described in claim 1 wherein one of said baby carrier means comprises a jumper seat having openings adapted to receive an infant's legs and to hold the infant in a generally upright position above said base, an elongate stabilizer bar, strap means connecting said jumper seat to opposite ends of said stabilizer bar, an elongate suspension bar, adjustable strap means connecting opposite ends of the stabilizer bar to the corresponding ends of said suspension bar for adjusting the height of the jumper seat above said base so that the infant's legs can reach and touch said base, and spring means connecting opposite ends of said suspension bar to said headbar so that an infant in the jumper seat may bounce up and down by pushing off against said base.

16. The apparatus as described in claim 13 wherein one of said baby carrier means comprises a cradle for holding an infant.

* * * * *

UNITED STATES PATENT AND TRADEMARK OFFICE

CERTIFICATE OF CORRECTION

PATENT NO. : 4,948,120

DATED : August 14, 1990

INVENTOR(S) : Deborah Krueger & Damon Snyder

It is certified that error appears in the above-identified patent and that said Letters Patent is hereby corrected as shown below:

IN THE ABSTRACT:

Line 9, after "jumper" (second occurrence), delete "set" and insert --seat--.

Column 2, line 33, after "in" (second occurrence), delete "crosssection" and insert --cross-section--.

IN THE CLAIMS:

Column 6, line 23, after "tion," and before "a", insert --(new paragraph)--.

Column 6, line 50, after "claim", delete "!1", and insert --11--.

Column 8, line 3, after "claim", delete "1", and insert --13--.

Signed and Sealed this

Twenty-seventh Day of August, 1991

*Attest:*

HARRY F. MANBECK, JR.

*Attesting Officer*

*Commissioner of Patents and Trademarks*